US007065006B2

(12) United States Patent
Ciervo

(10) Patent No.: US 7,065,006 B2
(45) Date of Patent: Jun. 20, 2006

(54) METHOD FOR ENABLING DISPLAYABILITY/INHIBITABILITY OF MODE FUNCTIONS IN A MULTIMODE ELECTRONIC DEVICE

(75) Inventor: Richard D. Ciervo, New Britain, CT (US)

(73) Assignee: Timex Group B.V. (NL)

( * ) Notice: Subject to any disclaimer, the term of this patent is extended or adjusted under 35 U.S.C. 154(b) by 293 days.

(21) Appl. No.: 10/744,885

(22) Filed: Dec. 23, 2003

(65) Prior Publication Data

US 2005/0135197 A1 Jun. 23, 2005

(51) Int. Cl.
*G04C 17/00* (2006.01)

(52) U.S. Cl. ..... 368/223; 368/69

(58) Field of Classification Search ..... 368/69, 368/70, 224, 223; 715/764, 765, 810, 864
See application file for complete search history.

(56) References Cited

U.S. PATENT DOCUMENTS

| | | | | |
|---|---|---|---|---|
| 4,283,784 | A | 8/1981 | Horan | |
| 4,587,630 | A | 5/1986 | Straton et al. | |
| 4,780,864 | A | 10/1988 | Houlihan | |
| 4,783,773 | A | 11/1988 | Houlihan et al. | |
| 4,989,188 | A | 1/1991 | Thinesen | |
| 5,140,563 | A * | 8/1992 | Thinesen | 368/70 |
| 5,477,508 | A * | 12/1995 | Will | 368/189 |
| 5,555,226 | A | 9/1996 | Lizzi | |
| 5,587,971 | A | 12/1996 | Thinesen | |
| 5,805,121 | A | 9/1998 | Burgan et al. | |
| 5,861,797 | A | 1/1999 | Becker | |
| 6,023,256 | A | 2/2000 | Ng et al. | |
| 6,146,010 | A | 11/2000 | Plancon | |
| 6,324,124 | B1 | 11/2001 | Yuzuki | |
| 6,418,394 | B1 * | 7/2002 | Puolakanaho et al. | 702/139 |
| 6,420,959 | B1 * | 7/2002 | Lizzi | 340/7.39 |
| 6,604,851 | B1 * | 8/2003 | Lizzi et al. | 368/187 |
| 2004/0190380 | A1 * | 9/2004 | Wojcieszak | 368/69 |

* cited by examiner

*Primary Examiner*—Andrew H. Hirshfeld
*Assistant Examiner*—Leo T. Hinze
(74) *Attorney, Agent, or Firm*—Carmody & Torrance LLP

(57) ABSTRACT

A method of enabling the displayability of at least one hidden mode in a multimode electronic device, wherein the method comprises the steps of determining that data in the at least one hidden mode satisfies a specified condition; and causing the mode indicator of the hidden mode to be displayable during a step of cycling among the viewable modes; wherein the at least one hidden mode is available for selecting from the viewable modes in the mode selecting mode. An electronic device that can carry out the foregoing methodology is also provided. In a preferred embodiment, the electronic device is a timepiece and specifically, a wristwatch.

13 Claims, 2 Drawing Sheets

METHOD FOR ENABLING DISPLAYABILITY/INHIBITABILITY OF MODE FUNCTIONS IN A MULTIMODE ELECTRONIC DEVICE

BACKGROUND OF THE INVENTION

The present invention relates generally to user interface methodologies for electronic devices, such as, but not limited to timepieces such as watches, and in particular, to an improved methodology for an electronic device that enables the displayability and inhibitability of modes and their functions from within a larger set of a plurality of modes, thus being able to more particularly and desirably customize the use and functionality of the electronic device.

Watches having a plurality of modes are well known and described in a multitude of issued patents, such as, but not limited to, U.S. Pat. Nos. 4,783,773; 4,780,864; 5,555,226; and 4,283,784. The disclosures of such patents are incorporated by reference as if fully set forth herein.

There continues to be a push towards incorporating more and more functionality into such electronic devices, such as providing more and more modes that a user may find useful and/or desirable. Aside from the common modes found in such electronic devices (e.g. time-of-day (TOD) mode, date (DATE) mode, chronograph (CHRONO) mode, alarm (ALARM) modes, countdown (TIMER) modes, and even alternate time zone (T2) modes), such devices are becoming more versatile. For example, heartrate monitors are being incorporated into wristwatches and therefore, additional modes such as heartrate (HR) modes where one can monitor his/her own heartrate during a workout are being provided. Still further, by developing a communication link with a GPS, the speed (SPEED) and distance (DIST) traveled of the user can be monitored in a SPEED mode and/or a DIST mode, for example, and can be displayed and recalled later during workout summaries. The technology to provide such functionality is well known and not relevant to the present invention.

To still better appreciate the scope and potential of the present invention, it should also be recognized that the foregoing is but just a few examples of functionality being provided in such electronic devices. Other available features put in such devices are described in U.S. Pat. No. 5,737,246 (electronic wristwatch with water depth measuring capability); U.S. Pat. No. 6,314,058 (describing a "health watch" for digitally displaying a plurality of information, such as time, atmospheric temperature, body temperature, heart rate and blood pressure); U.S. Pat. No. 4,407,295 (describing a miniature portable physiological parameter measuring system with interchangeable sensors); and U.S. Pat. No. 6,356,856 (describing a system for measuring the speed of a person while running or walking along a surface), and are only but a few examples. As therefore can be seen, the prior art generally recognizes that a timepiece, such as a wristwatch, can be provided with a plurality of modes, although not all of which need be (or usually can be) utilized or employed simultaneously.

All of these modes may be accessed in a number of ways, such as through the sequencing thereof using manually actuatable side and top pushers, and even more recently by the use of a rotating stem and/or top ring, as more particularly set forth in commonly owned U.S. Pat. Nos. 6,146,010 and 6,203,190 as well as application Ser. No. 09/359,223, filed on Jul. 22, 1999, entitled "Setting Functions For A Multimode Timepiece" by G. Stotz, et al., the disclosures of which are all incorporated by reference as if fully set forth herein.

As would be expected, watch designers and programmers are continuously striving for, constructing and/or designing such electronic devices, such as watches, to be more and more "user friendly" by providing a user with more and more available modes while at the same time attempting to permit the user to cycle through such modes more easily and conveniently.

A perceived deficiency in the prior art is not in the providing of users with more and more options (i.e. functionality and/or modes), but rather is in the potential information overload and frustration that such voluminous information availability causes. That is, what modes may be desirable for one user may be useless for another user. Still further, modes not being immediately utilized could advantageously be (at least temporality) hidden from view. For example, a user not currently under water may not need (or desire) to be required to scroll through the mode that displays water pressure, as suggested above. Similarly, a user not currently connected to a heartrate monitor (e.g. a chest strap) need not have (or want) to scroll through the HR mode, since it would be intuitively clear that there is no current workout in progress. As but another example, a user need not want to scroll through the SPEED and/or DIST mode when not operatively coupled to a GPS, since it could be assumed that the displayable data would either be "zero" or stale (i.e. old).

U.S. application Ser. No. 09/727,886, the disclosure of which is also incorporated by reference as if fully sets forth herein, discloses and claims significant advances in the art in the foregoing regard by providing methodologies and constructions for being able to manually disable and enable modes in such an electronic device. However, it is believed that yet further advances in the art are desirable. Specifically, it is desirable to provide methodologies and constructions that determine whether data in one or modes satisfies and/or fails to satisfy a specified condition, and depending thereon, being able to cause the mode to be displayable or inhibited from display, as the case may be, again, all in order to customize and improved the functionality of the electronic device.

Accordingly, it is desirable to provide an electronic device that can still be further customized and more particularly configured to a user's customized use thereof. The present invention achieves the aforementioned and below mentioned advantages.

OBJECTS AND SUMMARY OF THE INVENTION

Accordingly, it is an object of the present invention to provide an improved programming and mode display methodology for multimode electronic devices and, in particular, of a wristwatch, that allows an electronic device to customize itself to the use of the user.

It is another object and advantage of this invention to provide an improved mode display methodology for such electronic devices that makes the device more "user friendly" and customizable to the user.

It is yet another object and advantage of this invention to provide an improved mode display methodology that makes the device more marketable to a wider range of users.

It is still another object and advantage of this invention to provide an improved mode display methodology that permits manufactures, designers or programmers of such devices to further provide users with demanded functionality, yet provide a construction and methodology to permit the electronic device to configure itself to better meet the users needs, desires and uses therefor.

It is a further object of the present invention to provide a multimode device that can provide additional mode capability and functionality.

Another object of the present invention is to provide a device having an improved multi-level user interface.

Further objects and advantages of this invention will become more apparent from a consideration of the drawings and ensuing description.

The foregoing and other problems are overcome and the objects and advantages are realized by methods and constructions in accordance with embodiments of this invention, wherein improved mode selecting and programming methodologies and a construction thereof for a multimode electronic device are disclosed.

Accordingly, in accordance with the present invention, a method of enabling the displayability of at least one hidden mode in a multimode electronic device is provided. The device is preferably of the type that has an integrated circuit operable in a plurality of modes, wherein the plurality of modes comprises a mode selecting mode, viewable modes each of which has associated therewith a mode indicator, and the at least one hidden mode which itself has associated therewith a mode indicator, wherein in the mode selecting mode, the electronic device cycles among at least the viewable modes and displays the mode indicators for the respective viewable modes but does not display the mode indicator for the at least one hidden mode, such that the display of a mode indicator precedes the selectability of the viewable mode whose mode indicator is being displayed. The method of enabling the displayability of the at least one hidden mode preferably comprises the steps of determining that data in the at least one hidden mode satisfies a specified condition; and causing the mode indicator of the hidden mode to be displayable during a step of cycling among the viewable modes; wherein the at least one hidden mode is available for selecting from the viewable modes in the mode selecting mode. Preferably, the failure of the data to satisfy the specified condition results in that the hidden mode remains viewinhibited during the step of cycling among the viewable modes, wherein upon the satisfaction of the condition, the at least one hidden mode becomes available for selecting from the viewable modes in the mode selecting mode. An electronic device that carries out the foregoing methodology is also provided.

In yet another embodiment, the method comprises the steps of determining if data in a multi-dataset mode satisfies a specified condition; and if so: displaying the data in the multi-dataset mode that satisfies the condition during a step of cycling among the data sets of the multi-dataset mode; and if not: inhibiting the displaying of the one or more datasets that do not satisfy the condition. Likewise, an electronic device to carry out the foregoing methodology is also provided.

In each of the foregoing embodiments, the condition may be whether the data is non-zero or has been updated and/or changed in a last predetermined period and/or is available for displayability. To be sure, the length of the predetermined period since last update or change is a design choice, and may be by way of example, 1 day, 2 days, 3 days, etc.

Methodologies for inhibiting the display of at least one viewable mode and/or data in a multi-dataset mode, and an electronic device to carry out such methodologies is also provided.

In each of the preferred embodiments, the electronic device is preferably a timepiece and a wristwatch in particular.

DETAILED DESCRIPTION OF THE PREFERRED EMBODIMENT

As set forth in the Background Section above, and as will be appreciated below, there are many mechanical embodiments that can carry out the present invention. Preferred mechanical embodiments may incorporate a rotating switching mechanism and/or may merely use side and/or top mounted pushers, all as disclosed in the aforementioned patents and applications.

Again, by way of background, the present invention is intended to complement and further the state of the art, which is now believed to be that described and claimed in U.S. application Ser. No. 09/727,886. However, in distinction to the descriptions in this '886 application which disclose the ability for a user to enable and/or disable mode functions that are provided for in the electronic device, such as within a "library" of modes stored within the memory of the electronic device, the present invention is intended to provide methodologies to enable the electronic device itself to enable/inhibit the displayability of modes, and in particular, by determining in effect if a particular mode has been, for example, used, or if the data in the mode has been changed or updated during a previous period of time.

Also, it is clearly contemplated that all the viewinhibitable modes may initially be displayable, thus requiring the electronic device to determine whether the display of a mode should be thereafter inhibited. Alternatively, the display of all viewinhibitable modes could be initially inhibited, only to be displayable upon meeting the one or more criterions and/or satisfying the conditions disclosed herein.

Figure 1:
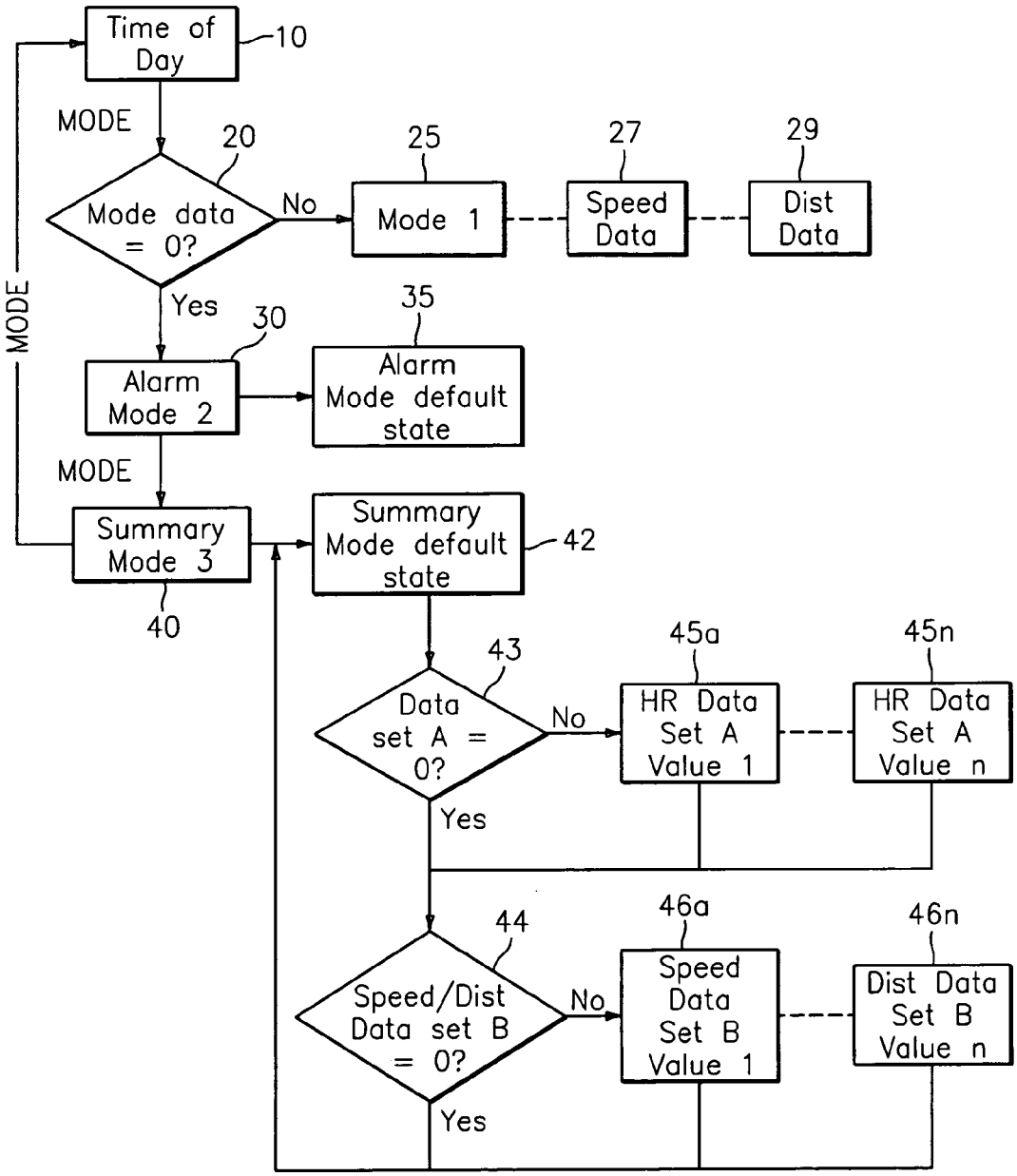
FIG. 1 illustrates a flow diagram of an exemplary methodology in accordance with the present invention, provided to be used in connection with an electronic device, such as, but not limited to, a watch.

To set forth the preferred methodology of the present invention, reference should be had to FIG. 1, although it should be understood that the following has been simplified to clearly explain the implementation of the present invention. Such simplification should be understood as exemplary and not by way of limitation.

Furthermore, by way of terminology, the "mode selector" may be a dedicated pusher (hereinafter coined the "mode button") as would be well known in the art, or may be comprised of a rotating switching mechanism that is positionable in at least two axial positions, such as that disclosed in co-pending application Ser. No. 09/327,769. The included integrated circuit is operable in at least an active mode state being the mode in which the device may be in (i.e. TOD, DATE, ALARM, SPEED, DIST, HR etc.) and a mode selecting mode in which the device is capable of cycling among and between a plurality of modes. The mode button may permit operatively cycling among the modes and/or the rotating switching mechanism may perform this function when it is a selected one of the axial positions. Selection of a next mode from the plurality of modes may be achieved by rotating the switching mechanism either clockwise or counterclockwise until the next active mode is exhibited, while continued depression of the mode button would achieve the same effect.

To best illustrate (by example, and not limitation) the advantages of the present invention, reference will be made to the flow diagram of FIG. 1. For simplicity, it is assumed that the device incorporating the methodology of FIG. 1 has at least the following modes: TOD (always present), SPEED/DIST (for providing information regarding a current workout); ALARM (always present); and SUMMARY (providing recent workout summaries of heartrate, speed and distance results of prior two (2) workouts). Again, the foregoing is by example and not limitation, as the versatility of the present invention is far further reaching, as should be readily understood. For ease of understanding, and at least in the exemplary device, a HR mode would be included as a mode, and would function and have the same viewinhibitable characteristics as that of the exemplary CURRENT SPEED/DIST mode.

Furthermore, it is assumed that each actuation of the mode button or, if the device incorporates a rotating switching mechanism, each clockwise (CW) or counterclockwise (CCW) rotation of the switching mechanism (while in a selected axial position) selects the next mode from within the Mode List.

Now, turning to the particulars of FIG. 1, it may be assumed that the device is in the TOD mode (BLOCK 10). The next mode accessible in the Mode List of FIG. 1 is that of the Current Speed/Distance (current SPEED/DIST). Again, this mode is provided and used to display current speed and distance of a user when the electronic device is in communication with a GPS, although a user may intuitively wish to skip this mode if in fact he/she was not in communication with the GPS. Therefore, as will become clear below, this mode is viewinhibitable.

The third mode, ALARM mode, is provided to show another example of a mode that is preferably not viewinhibitable, notwithstanding it is unlikely that the data changes frequently.

Illustrated last in FIG. 1 is the SUMMARY mode designated by reference numeral 40, which by way of example, will display parameters from the most recent (e.g. 2) workouts related to heartrate, speed and distance. It should be understood that more or less summary results are contemplated and within the scope of the invention.

From the TOD mode, depression of the mode button or rotation of the switching mechanism as set forth above would cause the device to leave the TOD mode. However, prior to displaying the mode banner for a viewinhibitable (i.e. hidden) mode (e.g. current SPEED/DIST), the electronic device determines if the data in such a viewinhibitable mode satisfies a specified condition. In the present invention, such a condition (i.e. parameter) may be whether the data is non-zero, has been updated during a recent predetermined amount of time (e.g. 1 day, 2 days, 3 days, etc.) or whether such data has been changed. If one or more of such conditions have been satisfied, then it may be presumed (for the convenience of the understanding of the invention), that the features provided by the current speed and distance mode are being used, and hence, the mode indicator (e.g. banner) of the viewinhibitable (i.e. hidden) mode to be displayable will be displayed during a step of cycling among the viewable modes (or, in a subsequent cycling step assuming it was skipped over in a previous cycle due to the failure of the satisfying of the condition). In this way, the now previously hidden mode (here, current SPEED/DIST) is available for selecting from the viewable modes in the mode selecting mode. Clearly, as shown by Blocks 25, 27 and 29, if the data satisfied the condition, the mode would be entered (Block 25) and the current speed (Block 27) and distance traveled (Block 29) would be displayed (e.g. upon repeated actuations (or rotation) of the pusher (or rotating switching member)). Clearly, the ordering of the data in Blocks 27, 29 are mere design choices.

If however, at Block 20, the determination of the satisfaction of the one or more conditions was negative, the mode (and hence the mode indicator) for the current SPEED/DIST would not be displayed, and hence viewinhibited. As can be seen, this advantageous feature allows the electronic device to be more intuitive to the uses of the device by the current user.

Thereafter, upon the depression of the mode button or the further rotation of the switching mechanism, the methodology would move to Block 30 where, in the present example, the ALARM mode banner would be displayed (Block 35). As is well known in the art, without further actuation of the mode button or without further rotation of the rotating switching mechanism after the exhibiting of the selected mode, the device preferably enters the particular mode (i.e. Block 25, or Block 35, or Block 45 respectively). In this way, setting and/or viewing of the dataset(s) of the particular mode occurs. Preferably, non-rotation of the rotating switching mechanism or non-depression of the mode button for 1.5 seconds will cause the device to enter the selected mode. The utilization of the 1.5-second delay permits a user to identify the particular mode for which entry may be desired, all of which currently exists in watches on the market.

Continuing with the flow diagram of FIG. 1, rotation of the switching mechanism (or depression of the mode button) would cause the methodology to arrive at Block 40, wherein after a 1.5 second delay, the mode would be entered, as the SUMMARY mode by way of example is provided generally as a non-viewinhibitable mode but as will become clearer below, datasets within the mode are viewinhibitable.

Here the SUMMARY mode has multiple datasets (for illustration purposes). For example, upon entering the SUMMARY mode, repeated actuation of the mode selector would cause the user to arrive at a decision Block 43. By way of example, Block 43 queries whether there is any HR summary data to be displayed, while decision Block 44 similarly queries whether there is any speed and/or distance summary data to be displayed. At each decision Block 43 and 44, if it is determined that there is data in the respective dataset that satisfies a specified condition (e.g. is non-zero, has been recently updated and/or changed), the data in the particular multi-dataset mode that satisfies the condition will be displayed during a step of cycling among the data sets of the multi-dataset mode. If the data in each of the datasets (45*a*–45*n* or 46*a*–46*n*) fails the one or more conditions (e.g. is zero, has not been recently updated and/or changed), the electronic device will inhibit the displaying of the one or more datasets.

For example, if the decision step at Block 43 determines that all recent HR data is zero, has not been recently updated and/or changed (e.g. in the last several workouts, no chest strap has been used), then the methodology skips the display of such "nondata" and the methodology moves directly to step 44 where it is determined whether there is a history of speed and distance data to be displayed in the same manner as above. As should be understood, one or more pushers or rotations of the switching mechanism would provide the sequencing in and among Blocks 45*a*–45*n*; 46*a*–46*n* as should be understood in the art. Clearly then, there could be a decision block intermediate every two or more datascreens (46*a*, . . . 46*n*). In this way, still further optimization of display can be achieved.

Figure 2:
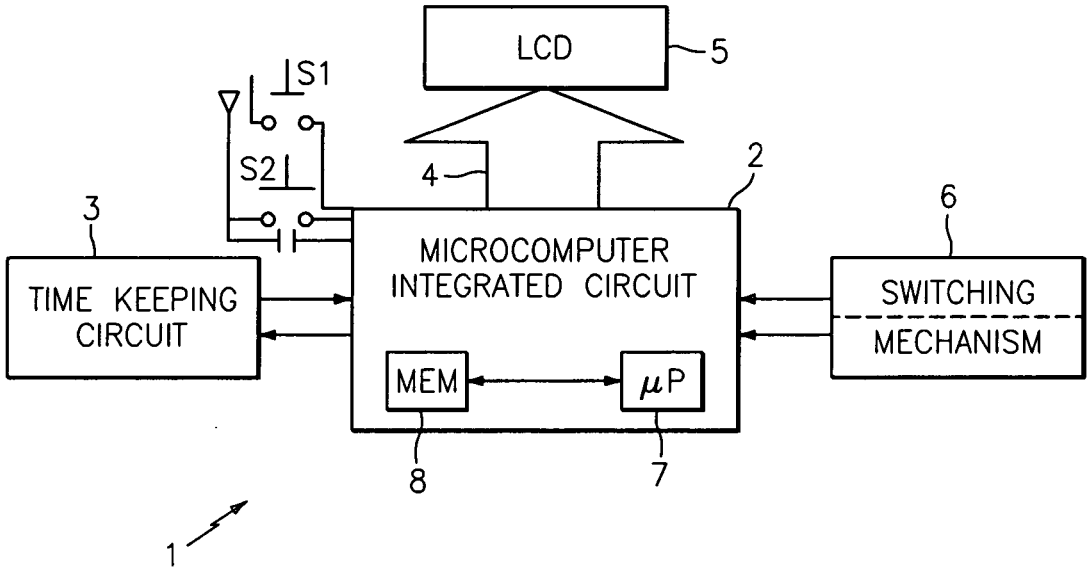
FIG. 2 is a simplified block diagram of an integrated circuit and other components of a multimode electronic device constructed to carry out the present invention.

While the foregoing sets forth the methodology for carrying out the preferred embodiment of the present invention, some points should be made for completeness. For example, setting and updating information within the mode can be done in accordance with known methodologies. Moreover, it is envisioned that there could be one or more dedicated mode (i.e. function) buttons. Lastly, while the present methodology, as repeatedly stated above, is essentially independent of the mechanical embodiment used to carry it out, it is preferred that some disclosure be provided. FIG. 2 illustrates components of circuitry of a multimode, multifunctioning electronic timepiece 1 configured in accordance with the present invention. The circuitry is disposed within a cavity of the device's casing (not shown) and may be operable for performing, among other things, timekeeping functions. The circuitry includes a programmable microcomputer 2 in the form of an integrated circuit chip. The microcomputer 2 includes a microprocessor 7 programmed to perform instructions suitable for achieving the timekeeping functions and all the mode selecting and operating as disclosed above. The microcomputer also includes a memory device 8. The memory device 8 may store, for example, data values and/or variables used by the microprocessor 7 in one or more operating modes of the device. In particular, the memory device may store the electronic timepiece setting and mode selecting methodologies as software routines retrieved and executed by microprocessor 7 in accordance with the present invention. As can be appreciated, the circuitry may also include a timekeeping circuit 3, which generates time indicating signals representing, among other things, a time-of-day. Signals from the timekeeping circuit 3 as well as other signals from, for example, the switching mechanism, whether by the switching mechanism 6 which may comprise the aforementioned rotating switching mechanism or may comprise pushbuttons S1 and/or S2, are processed by the microcomputer 2. The signals are passed to the microprocessor 7 for processing to change, for example, the value of information or mode banners on the display through a predetermined sequence. Other details of the workings of the device, such as backlighting or how the high frequency time base is established is so well known in the art that no further details need be made thereto. An output signal via a display bus 4 is provided to a display such as, for example, a liquid crystal display 5. The LCD 5 exhibits the time of day, other time measuring quantities, and other information as set forth and indicated above and/or as instructed by the microcomputer 2.

Lastly, while the foregoing is a somewhat simplified circuit diagram, it is believed to be sufficient for proposes of enablement and bestmode for the present invention, especially in view of the knowledge of the ordinarily skilled artisan. However, for still further details that may be applicable and useful in carrying out objectives and advantages that could be appreciated by the present invention, one may wish to review copending and coowned application Ser. No. 10/441,417 entitled "Wearable Electronic Device With Multiple Display Functionality," the subject matter of which is also incorporated by reference as if fully set forth herein. With such disclosure, it should be appreciated that the present invention (i.e. the electronic device and the methodologies) can enable/inhibit the displayability of modes based upon the availability of the displayable data, either from an internal sensor (such as a temperature sensor) or from an external sensor (such as a heart rate monitor transmitter). In this embodiment therefore, the condition to be satisfied may be the availability of data in the first instance. Accordingly, as disclosed in the cited documents herein, it is contemplated that one device, such as the electronic device of the present invention, be provided with the versatility to receive multiple sensors, with the mode for the particular sensor (e.g. HR, BP, TEMP, etc.) being displayable only if such associated sensor is connected thereto. This feature provides for yet additional advantages and benefits consistent with that set forth herein.

It can thus be seen that the present invention provides an improved programming and mode display methodology for multimode electronic devices and, in particular, of a wristwatch, that allows the electronic device to customize itself to the use of the user. Further, by implementing the present invention, an improved mode display methodology for such electronic devices that makes the device more "user friendly" and customizable to the user is provided. Still further, the present invention provides an improved mode display methodology that makes the device more marketable to a wider range of users. Lastly (but not exhaustively), the present invention provides an improved mode display methodology that permits manufactures, designers or programmers of such devices to further provide users with demanded functionality, yet provide a construction and methodology to permit the electronic device to configure itself to better meet the users needs, desires and uses therefor.

It can thus be seen that the present disclosure provides a method of enabling the displayability of at least one hidden mode in a multimode electronic device of the type having an integrated circuit operable in a plurality of modes, wherein the plurality of modes comprises a mode selecting mode, viewable modes each of which has associated therewith a mode indicator, and the at least one hidden mode which itself has associated therewith a mode indicator, wherein in the mode selecting mode, the electronic device cycles among at least the viewable modes and displays the mode indicators for the respective viewable modes but does not display the mode indicator for the at least one hidden mode, such that the display of a mode indicator precedes the selectability of the viewable mode whose mode indicator is being displayed, wherein the method of enabling the displayability of the at least one hidden mode comprises the steps of determining that data in the at least one hidden mode satisfies a specified condition; and causing the mode indicator of the hidden mode to be displayable during a step of cycling among the viewable modes; wherein the at least one hidden mode is available for selecting from the viewable modes in the mode selecting mode; whereby the failure of the data to satisfy the specified condition results in that the hidden mode remains viewinhibited during the step of cycling among the viewable modes, and upon the satisfaction of the condition, the at least one hidden mode becomes available for selecting from the viewable modes in the mode selecting mode.

Consistent therewith, an electronic circuit that provides for the displayability of at least one hidden mode among a plurality of modes is also provided. Again, the plurality of modes comprises a mode selecting mode, viewable modes each of which has associated therewith a mode indicator, and the at least one hidden mode which itself has associated therewith a mode indicator. In this embodiment, the electronic device comprises a display for displaying the viewable modes and the mode indicators associated therewith; an integrated circuit operable in the plurality of modes, wherein in the mode selecting mode, the electronic device cycles among at least the viewable modes and displays the mode indicators for the respective viewable modes but does not display the mode indictor for the at least one hidden mode, wherein the display of a mode indicator precedes the selectability of the viewable mode whose mode indicator is being displayed; and wherein when the integrated circuit determines that data in the at least one hidden mode satisfies a specified condition, the mode indicator for the at least one hidden mode is displayable during a subsequent step of cycling among the viewable modes; wherein the at least one hidden mode is now available for selecting in the mode selecting mode.

Yet further, in an electronic device of the type having an integrated circuit operable in at least a plurality of modes, wherein the plurality of modes comprises a mode selecting mode and viewable modes each of which has associated therewith a mode indicator and at least one of which is a multi-dataset mode for displaying a first data set and at least a second data set, wherein in the mode selecting mode the electronic device cycles among the viewable modes and makes available for viewing the first data set and the at least second data set in the multi-dataset mode, wherein the first data set and the at least second data set are separately displayable, the foregoing disclosure sets forth a method of displaying the data in the multi-dataset mode comprising the steps of determining if the data in the first data set and/or the at least second data satisfies a specified condition; and if so: displaying the data in the multi-dataset mode that satisfies the condition during a step of cycling among the data sets of the multi-dataset mode; and if not: inhibiting the displaying of the one or more datasets that do not satisfy the condition.

In each of the foreign embodiments, the condition preferably may be whether the data is non-zero or has been updated and/or changed in a last predetermined period or alternatively, whether the data is available in the first instance for displayability.

Lastly, a method of inhibiting the display of at least one viewable mode is provided. Here, such a method may be carried out in a multimode electronic device of the type having an integrated circuit operable in a plurality of modes comprising a mode selecting mode, a plurality of viewable modes each of which has associated therewith a mode indicator, and a viewinhibitable mode which itself has a mode indicator associated therewith, wherein in the mode selecting mode the electronic device cycles among at least the viewable modes and the viewinhibitable mode and displays the mode indicators for the respective viewable modes and the viewinhibitable mode, such that the display of a mode indicator precedes the selectability of the associated mode whose mode indicator is being displayed. Such a method of inhibiting the display of the at least one viewinhibitable mode preferably comprises the steps of determining that data in the at least one viewinhibitable mode fails to satisfy a specified condition; and causing the display of the mode indicator of the viewinhibitable mode to be inhibited during a subsequent step of cycling among the viewable modes; wherein the at least one viewinhibitable mode is inhibited from display in the mode selecting mode during a cycling step. An electronic device that provides for inhibiting the display of such a viewable mode preferably comprises a display for displaying the viewable modes and the mode indicators associated therewith; an integrated circuit operable in the plurality of modes, wherein in the mode selecting mode the electronic device cycles among at least the viewable modes and the viewinhibitable mode and displays the mode indicators for the respective viewable modes and the viewinhibitable mode, such that the display of a mode indicator precedes the selectability of the associated mode whose mode indicator is being displayed, wherein when the integrated circuit determines that data in the at least one viewable mode fails to satisfy a specified condition, the mode indicator of the viewinhibitable mode is inhibited from display during a subsequent step of cycling among the viewable modes; wherein the at least one viewinhibitable mode is inhibited from display in the mode selecting mode.

It will thus be seen that the objects set forth above, among those made apparent from the preceding description, are efficiently attained and, since certain changes may be made in the above constructions and methodologies without departing from the spirit and scope of the invention, it is intended that all matter contained in the above description or shown in the accompanying drawings shall be interpreted as illustrative and not in a limiting sense.

While the invention has been particularly shown and described with respect to preferred embodiments thereof, it will be understood by those skilled in the art that changes in form and details may be made therein without departing from the scope and spirit of the invention.

For example, the present invention can easily be modified to inhibit a plurality of modes if the electronic device determines that none of the modes within the group should be displayed, using the same criterions set forth above. That is, the present invention recognizes that groups of modes may be displayed and/or inhibited together, such as for example, SPORTS, HEALTH, TRAVEL, FITNESS, etc.

Lastly, the present invention has been disclosed above with particular reference to timepieces. However, one skilled in the art shall now appreciate that the present invention is equally applicable, and as claim herein, to devices other than timepieces, such as, but not limited to, clocks and security devices, such as wall mounted or hand-held devices for the home or office. Therefore, reference to a device in both the disclosure and the claims should be understood to refer to at least any of the aforementioned other devices. That is, the present invention is applicable in any electronic device such as those disclosed in which particular modes and their functions can be displayed or inhibited therefrom, in a manner disclosed herein.

What is claimed is:

1. A method of enabling the displayability of at least one hidden mode in a multimode electronic device of the type having an integrated circuit operable in a plurality of modes, wherein the plurality of modes comprises a mode selecting mode, viewable modes each of which has associated therewith a mode indicator, and the at least one hidden mode which itself has associated therewith a mode indicator, wherein in the mode selecting mode, the electronic device cycles among at least the viewable modes and displays the mode indicators for the respective viewable modes but does not display the mode indicator for the at least one hidden mode, such that the display of a mode indicator precedes the selectability of the viewable mode whose mode indicator is being displayed, wherein the method of enabling the displayability of the at least one hidden mode comprises the steps of:

determining that data in the at least one hidden mode satisfies a specified condition; and causing the mode indicator of the hidden mode to be displayable during a step of cycling among the viewable modes;

wherein the at least one hidden mode is available for selecting from the viewable modes in the mode selecting mode.

2. The method as claimed in claim 1, wherein the failure of the data to satisfy the specified condition results in that the hidden mode remains viewinhibited during the step of cycling among the viewable modes;

wherein upon the satisfaction of the condition, the at least one hidden mode becomes available for selecting from the viewable modes in the mode selecting mode.

3. The method as claimed in claim 1, wherein the condition is whether the data is non-zero or has been updated and/or changed in a last predetermined period.

4. The method as claimed in claim 1, wherein the condition is whether the data is available for displayability.

5. An electronic device that provides for the displayability of at least one hidden mode among a plurality of modes, wherein the plurality of modes comprises a mode selecting mode, viewable modes each of which has associated therewith a mode indicator, and the at least one hidden mode which itself has associated therewith a mode indicator, wherein the electronic device comprises:

a display for displaying the viewable modes and the mode indicators associated therewith;

an integrated circuit operable in the plurality of modes, wherein in the mode selecting mode, the electronic device cycles among at least the viewable modes and displays the mode indicators for the respective viewable modes but does not display the mode indictor for the at least one hidden mode, wherein the display of a mode indicator precedes the selectability of the viewable mode whose mode indicator is being displayed; and wherein when the integrated circuit determines that data in the at least one hidden mode satisfies a specified condition, the mode indicator for the at least one hidden mode is displayable during a subsequent step of cycling among the viewable modes;

wherein the at least one hidden mode is now available for selecting in the mode selecting mode.

6. The electronic device as claimed in claim 5, wherein the condition is whether the data is non-zero or has been updated and/or changed in a last predetermined period.

7. The electronic device as claimed in claim 5, wherein said electronic device is a timepiece.

8. The electronic device as claimed in claim 5, wherein the timepiece is a wristwatch.

9. A method of inhibiting the display of at least one viewable mode in a multimode electronic device of the type having an integrated circuit operable in a plurality of modes comprising a mode selecting mode, a plurality of viewable modes each of which has associated therewith a mode indicator, and a viewinhibitable mode which itself has a mode indicator associated therewith, wherein in the mode selecting mode the electronic device cycles among at least the viewable modes and the viewinhibitable mode and displays the mode indicators for the respective viewable modes and the viewinhibitable mode, such that the display of a mode indicator precedes the selectability of the associated mode whose mode indicator is being displayed, wherein the method of inhibiting the display of the at least one viewinhibitable mode comprises the steps of:

determining that data in the at least one viewinhibitable mode fails to satisfy a specified condition; and causing the display of the mode indicator of the viewinhibitable mode to be inhibited during a subsequent step of cycling among the viewable modes;

wherein the at least one viewinhibitable mode is inhibited from display in the mode selecting mode during a cycling step.

10. The method as claimed in claim 9, wherein the condition is whether the data is non-zero or has been updated and/or changed in a last predetermined period.

11. The electronic device as claimed in claim 9, wherein said electronic device is a timepiece.

12. An electronic device that provides for inhibiting the display of at least one viewable mode among a plurality of modes comprising a mode selecting mode, a plurality of viewable modes each of which has associated therewith a mode indicator, and a viewinhibitable mode which itself has a mode indicator associated therewith, wherein the electronic device comprises:

a display for displaying the viewable modes and the mode indicators associated therewith;

an integrated circuit operable in the plurality of modes, wherein in the mode selecting mode the electronic device cycles among at least the viewable modes and the viewinhibitable mode and displays the mode indicators for the respective viewable modes and the viewinhibitable mode, such that the display of a mode indicator precedes the selectability of the associated mode whose mode indicator is being displayed, wherein when the integrated circuit determines that data in the at least one viewable mode fails to satisfy a specified condition, the mode indicator of the viewinhibitable mode is inhibited from display during a subsequent step of cycling among the viewable modes;

wherein the at least one viewinhibitable mode is inhibited from display in the mode selecting mode.

13. The electronic device as claimed in claim 12, wherein the condition is whether the data is non-zero or has been updated and/or changed in a last predetermined period.

* * * * *